United States Patent [19]

Curtis et al.

[11] Patent Number: 4,871,333

[45] Date of Patent: Oct. 3, 1989

[54] COWL-LOCKING MECHANISM

[75] Inventors: Mark D. Curtis, Oshkosh; David Heidel, Green Lake, both of Wis.

[73] Assignee: Brunswick Corporation, Skokie, Ill.

[21] Appl. No.: 213,542

[22] Filed: Jun. 30, 1988

[51] Int. Cl.[4] ..... B63H 21/26

[52] U.S. Cl. ..... 440/77; 123/195 P

[58] Field of Search ..... 440/76, 77, 900; 123/195 P

[56] References Cited

FOREIGN PATENT DOCUMENTS 222894 10/1986 Japan ..... 440/77

*Primary Examiner*—Sherman D. Basinger

*Attorney, Agent, or Firm*—Andrus, Sceales, Starke & Sawall

[57] ABSTRACT

A locking mechanism for a two piece cowling for a marine engine includes a latch that is pivotally mounted on the lower cowling piece and includes a handle disposed within a recess on the exterior of the lower cowling so that when the latch is in its locked position, the handle is contained by the recess and is flush with the cowling so as not to detract from the styling of the cowling.

5 Claims, 1 Drawing Sheet

COWL-LOCKING MECHANISM

BACKGROUND OF THE INVENTION

The inner workings of a marine outboard engine are typically concealed by the use of a cowling that is secured in place through a locking or latching mechanism. Each outboard manufacturer has adopted its own shape or style for its cowling so that its product can easily be identified from a distance. The styling of the cowling is actually a factor considered by the customer when determining which type of outboard to purchase.

In the past, a "clam shell" desing was utilized for the cowling and the latching mechanism for this type of cowling was concealed by a front shield. As the styling evolved to a "bucket style" cowl, the latches could no longer be concealed by a front shield and it was necessary to design a locking mechanism that would not protrude from the cowling and detract from the classic styling of the cowling.

SUMMARY OF THE INVENTION

A locking mechanism for a two piece cowling for a marine engine includes a latch that is pivotally mounted on the lower cowling piece and which is movable between a locking position and a release position. The latch includes a handle portion which is disposed within a recess on the exterior of the cowling so that when the latch is in the locking position, the handle is flush with the cowling piece and blends with the styling of the cowling.

In accordance with another aspect of the invention, a coupling piece is disposed within the upper cowling piece and is engageable by the clamp portion of the latch when the latch is moved to its locking position.

The present invention thus provides a locking mechanism for a cowl that does not protrude from the cowling and thus detract from the shape and/or styling of the cowling.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
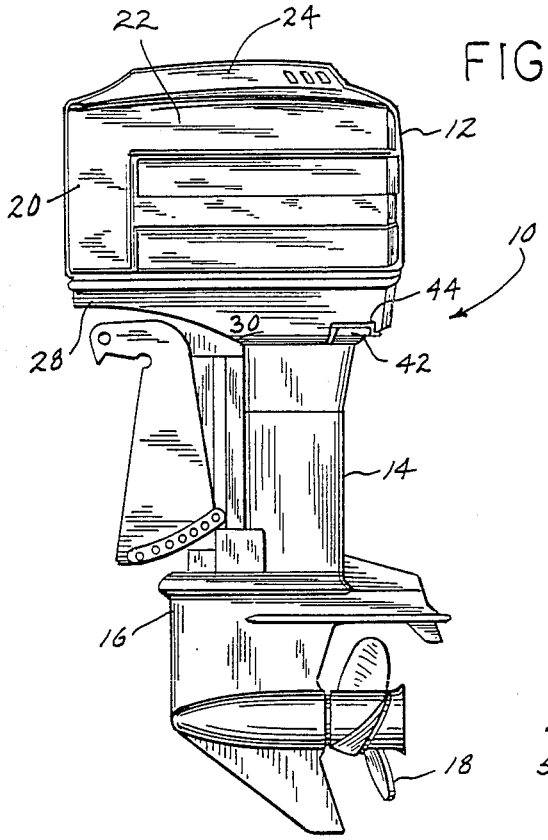
FIG. 1 is a side view of a marine outboard engine utilizing the cowl locking mechanism of the present invention.
Figure 2:
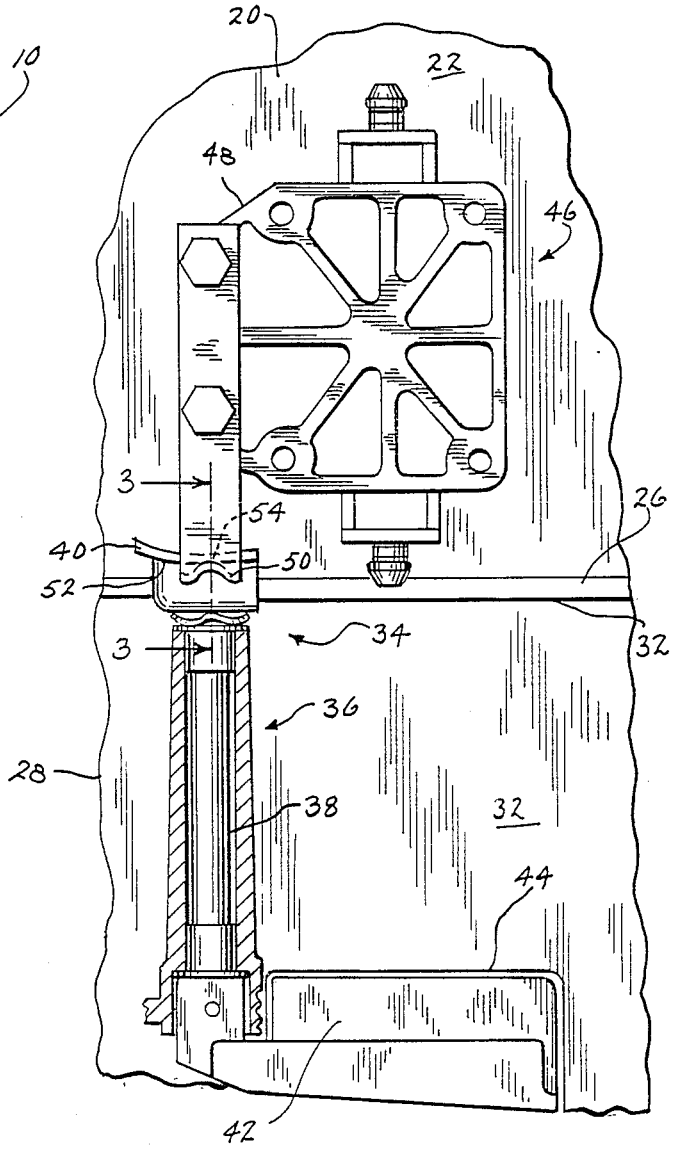
FIG. 2 is an enlarged side cross sectional view of the locking mechanism of FIG. 1.
Figure 3:
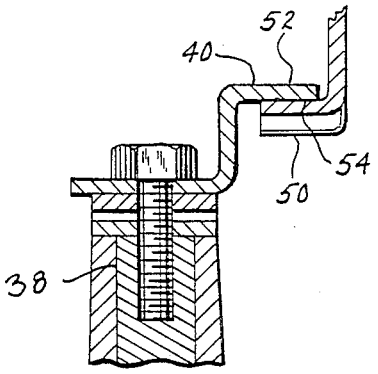
FIG. 3 is a sectional view along line 3—3 of FIG. 2.

As shown in FIG. 1, a marine outboard engine 10 includes a power head concealed by a cowling 12, a drive shaft housing 14 and a lower unit 16 including a propeller 18.

Cowling 12 includes an upper piece 20 having a plurality of sidewalls 22 joined by a top piece 24 so as to define a downwardly facing opening 26 and a lower piece 28 having a plurality of sidewalls 30 which define an upwardly facing opening 32.

Upper piece 20 and lower piece 28 are secured to each other by locking mechanism 34. Locking mechanism 34 includes a latch 36 that is pivotally mounted on the interior of sidewall 32 of lower cowling piece 28. Latch 36 includes a vertical post 38 which pivots about its longitudinal axis and on which is mounted a horizontally extending leg 40. The pivoting of post 38 is accomplished by handle 42 which is disposed within a recess 44 on the side of lower cowling piece 28. Thus, when latch 36 is in its locking position, as shown in all of the figures, handle 42 will be contained within recess 44 and will not protrude from the cowling so as to detract from the smooth styling of the cowling.

Latch 36 further includes a coupling piece 46 having a bracket 48 mounted on sidewall 22 of upper cowling piece 20. An engaging arm 50 extends from bracket 48 into the space defined by sidewalls 22. Leg 40 overlaps engaging arm 50 and is provided with a curved surface 52 which engages a curved surface 54 on engaging arm 50 when latch 36 is pivoted to its locking position.

In use, when it is necessary to obtain access to the power head, handle 42 is moved to a release position where it protrudes from cowling piece 28. With handle 42 in this position post 38 is rotated to a position where leg 40 is disengaged from arm 50. Upper cowling piece 20 may then be lifted off lower cowling piece 28.

While only a single latching mechanism has been shown and described it should be understood that an identical latching mechanism is located on the other side of the cowling.

The present invention thus provides a locking mechanism which when in its locked position is flush with the cowling so as not to detract from the styling or unique shape of the cowling.

It is recognized that various alternatives and modifications are possible in the scope of the appended claims.

We claim:

1. In a two piece cowling for a marine engine a locking mechanism for securing an upper cowling piece to a lower cowling piece, said locking mechanism comprising:

a latch mounted on one of the cowling pieces and movable about a vertical axis between a locking position and a release position, said latch having a handle portion disposed within a recess on the exterior of the side of the cowling piece so that when said latch is in said locking position said handle is flush with the side of the cowling piece and said latch having a clamp portion disposed within said cowling piece and operably connected to said handle, and a coupling piece disposed within the other of the cowling pieces and engageable by said clamp portion when said latch is moved to its locking position.

2. The locking mechanism defined in claim 1 wherein said latch is pivotally mounted on the lower cowling piece and said coupling piece is mounted on the upper cowling piece.

3. The locking mechanism defined in claim 1 wherein the upper cowling piece includes a plurality of vertical sidewalls defining a downwardly facing opening and said coupling piece comprises a bracket mounted on the interior of one of said sidewalls and an engaging arm extending from said bracket into the space defined by the sidewalls.

4. The locking mechanism defined in claim 1 wherein the lower cowling piece includes a plurality of sidewalls defining an upwardly facing opening and said clamp portion comprises a post pivotally mounted on the interior of one of said sidewalls and extending upwardly toward said opening and a leg extending from said post and engageable with said coupling piece, said post being pivoted by operation of said handle portion.

5. In a two piece cowling for a marine engine a locking mechanism for securing an upper cowling piece to a lower cowling piece, said locking mechanism comprising:

a latch pivotally mounted on the lower cowling piece and movable about a vertical axis between a locking position and a release position, said latch having a handle portion disposed within a recess on the exterior of the side of the cowling piece so that when said latch is in said locking position said handle is flush with the side of the cowling piece and said latch having a clamp portion disposed within said cowling piece and operably connected to said handle, and a coupling piece disposed within the upper cowling piece and engageable by said clamp portion when said latch is moved to its locking position.

* * * * *